US007861377B2

(12) United States Patent
Chuan

(10) Patent No.: US 7,861,377 B2
(45) Date of Patent: Jan. 4, 2011

(54) ABRASION-ENHANCED HINGE

(75) Inventor: Chih-Kuang Chuan, Shulin (TW)

(73) Assignee: Shin Zu Shing Co., Ltd., Shulin, Taipei Hsien (TW)

( * ) Notice: Subject to any disclaimer, the term of this patent is extended or adjusted under 35 U.S.C. 154(b) by 392 days.

(21) Appl. No.: 11/956,330

(22) Filed: Dec. 13, 2007

(65) Prior Publication Data

US 2009/0151122 A1 Jun. 18, 2009

(51) Int. Cl.
*E05D 11/08* (2006.01)

(52) U.S. Cl. ..... 16/338; 16/339; 16/386; 16/387

(58) Field of Classification Search ..... 16/295, 16/307, 338, 339, 340, 374, 376, 382, 386–387; 361/679.01–679.61; 248/291.1–292.13; 292/DIG. 17

See application file for complete search history.

(56) References Cited

U.S. PATENT DOCUMENTS

| | | | | | |
|---|---|---|---|---|---|
| 4,834,329 | A * | 5/1989 | Delapp | 248/183.3 |
| 5,026,028 | A * | 6/1991 | Ooi et al. | 256/67 |
| 5,269,047 | A * | 12/1993 | Lu | 16/340 |
| 5,507,719 | A * | 4/1996 | Freeman | 602/26 |
| 6,154,925 | A * | 12/2000 | Miura | 16/338 |
| 6,253,419 | B1 * | 7/2001 | Lu | 16/340 |
| 6,430,777 | B1 * | 8/2002 | Lu | 16/340 |
| 6,779,234 | B1 * | 8/2004 | Lu et al. | 16/340 |
| 6,813,813 | B2 * | 11/2004 | Lu et al. | 16/342 |
| 7,367,376 | B2 * | 5/2008 | Llagostera Forns | 160/66 |
| 7,640,628 | B2 * | 1/2010 | Hu | 16/340 |
| 7,712,188 | B2 * | 5/2010 | Sung | 16/339 |
| 2004/0025298 | A1 * | 2/2004 | Yang et al. | 16/340 |
| 2004/0055114 | A1 * | 3/2004 | Lu | 16/340 |
| 2005/0081334 | A1 * | 4/2005 | Tai | 16/339 |
| 2005/0108854 | A1 * | 5/2005 | Lee et al. | 16/340 |
| 2005/0155183 | A1 * | 7/2005 | Lu et al. | 16/340 |
| 2006/0191104 | A1 * | 8/2006 | Cho et al. | 16/340 |

* cited by examiner

*Primary Examiner*—Victor Batson
*Assistant Examiner*—Roberta Delisle
(74) *Attorney, Agent, or Firm*—patenttm.us

(57) ABSTRACT

An abrasion-enhanced hinge has a pintle, a washer assembly and a stationary leaf. The pintle is connected securely to a cover of an electronic device. The washer assembly has multiple stationary washers and multiple rotating washers. The stationary and rotating washers are mounted interlacedly around the pintle. The stationary washers are connected securely to each other. The rotating washers are connected securely to the pintle. The stationary leaf is connected securely to a base of the electronic device and is connected securely to the nearest stationary washer. When the cover is pivoted to the base, the pintle is rotated relative to the stationary leaf. Thus, the rotating washers are rotated relative to the stationary washers. Because the stationary and rotating washers are mounted interlacedly, the rotations between the stationary and rotating washers provide a lot of abrasions. Therefore, the hinge provides enhanced abrasion.

14 Claims, 9 Drawing Sheets

ABRASION-ENHANCED HINGE

BACKGROUND OF THE INVENTION

1. Field of the Invention

The present invention relates to a hinge, especially to a hinge being mounted between a cover and a base of an electronic device to provide enhanced abrasion.

2. Description of the Prior Arts

Electronic devices such as notebook computers, cell phones and the like have a cover with a display and a base. To allow the cover to be pivoted relative to the base, a hinge is mounted between the cover and the base. The hinge provides abrasion when the cover is pivoted to the base to maintain the cover at any desired angle. However, as the displays become larger and larger, the covers become heavier and heavier. Therefore, the abrasion providing by the conventional hinge is not enough to maintain the cover at any desired angle.

To overcome the shortcomings, the present invention provides an abrasion-enhanced hinge to mitigate or obviate the aforementioned problems.

SUMMARY OF THE INVENTION

The main objective of the present invention is to provide an abrasion-enhanced hinge. The abrasion-enhanced hinge has a pintle, a washer assembly and a stationary leaf. The pintle is connected securely to a cover of an electronic device. The washer assembly has multiple stationary washers and multiple rotating washers. The stationary and rotating washers are mounted interlacedly around the pintle. The stationary washers are connected securely to each other. The rotating washers are connected securely to the pintle. The stationary leaf is connected securely to a base of the electronic device and is connected securely to the nearest stationary washer. When the cover is pivoted to the base, the pintle is rotated relative to the stationary leaf. Thus, the rotating washers are rotated relative to the stationary washers. Because the stationary and rotating washers are mounted interlacedly, the rotations between the stationary and rotating washers provide a lot of abrasions. Therefore, the hinge provides enhanced abrasion.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
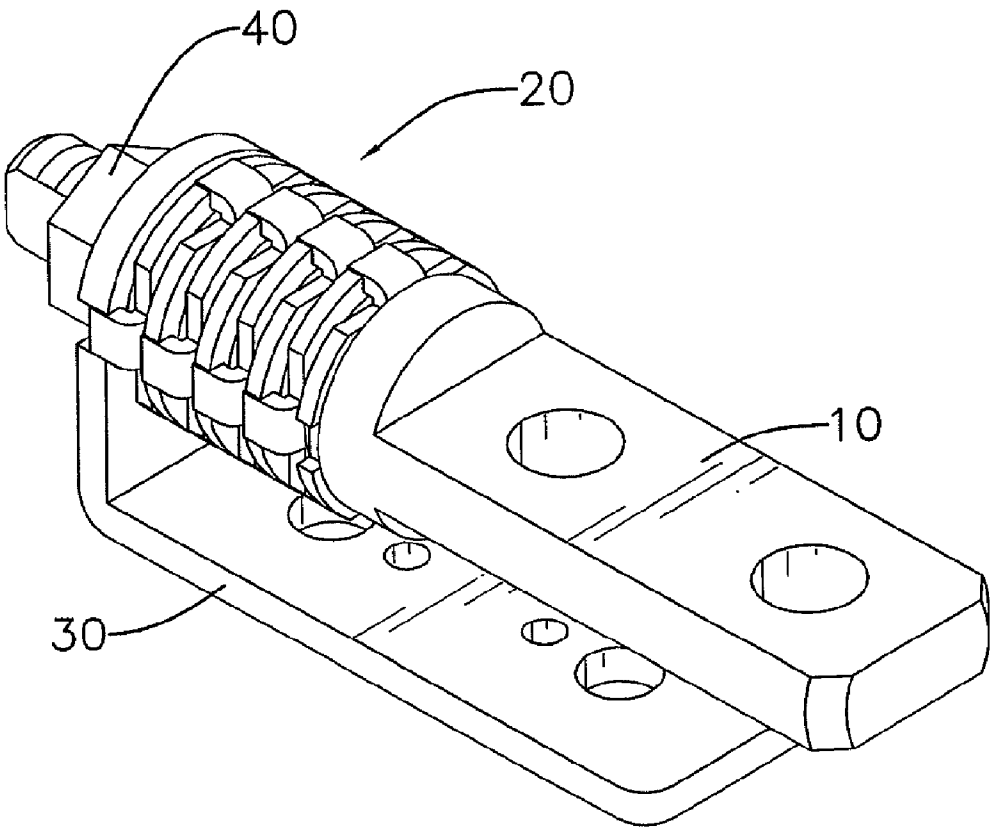
FIG. 1 is a perspective view of a first embodiment of an abrasion-enhanced hinge in accordance with the present invention.

With reference to FIGS. 1, 3, 6 and 8, an abrasion-enhanced hinge in accordance with the present invention comprises a pintle (10,10A), an optional adjusting sleeve (12), a washer assembly (20), a stationary leaf (30, 30A, 30B, 30C), an optional rotating leaf (35), a fastener (40) and an optional adjusting rod (50).

Figure 2:
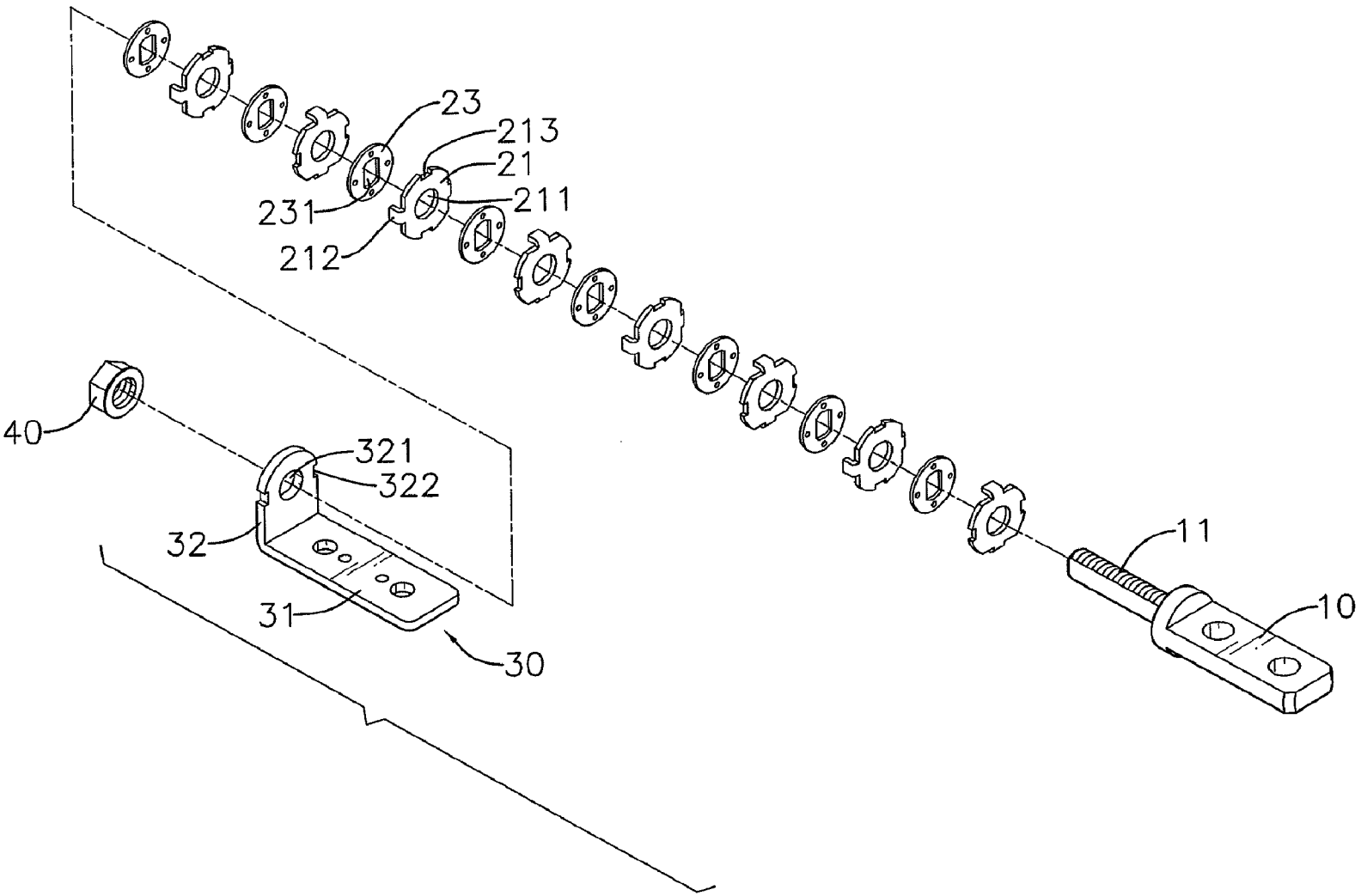
FIG. 2 is an exploded perspective view of the hinge in FIG. 1.
Figure 3:
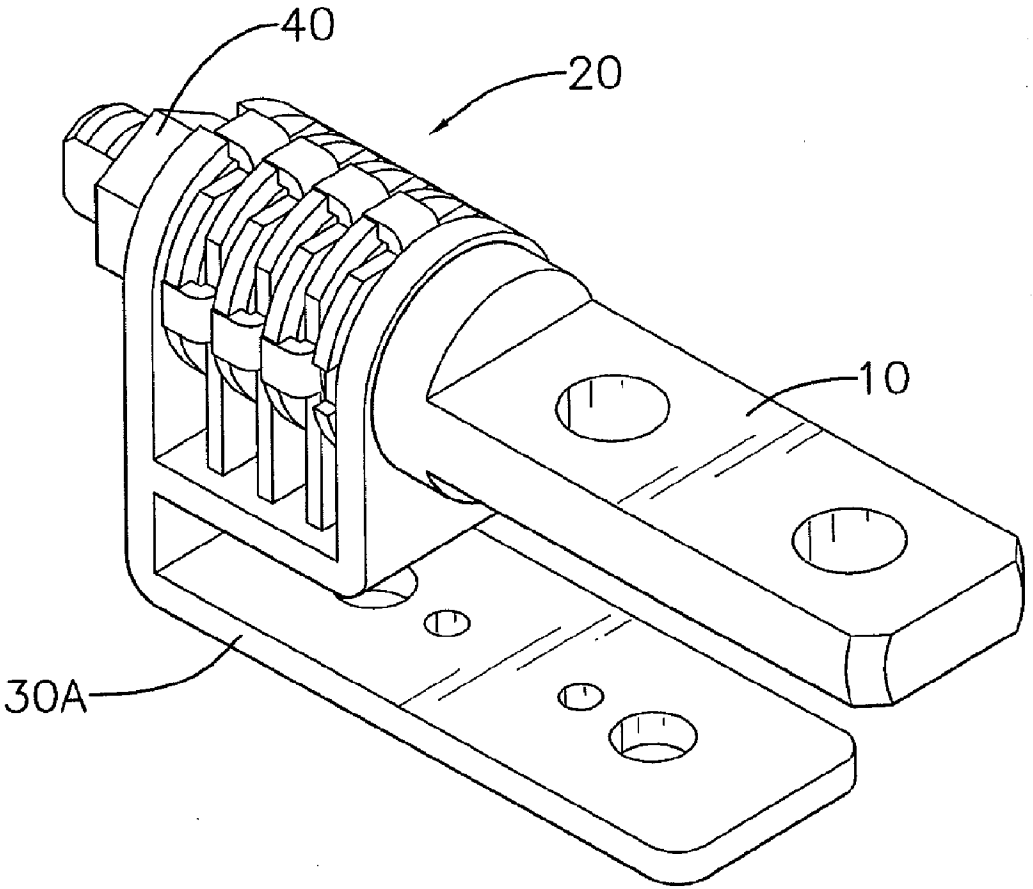
FIG. 3 is a perspective view of a second embodiment of an abrasion-enhanced hinge in accordance with the present invention.
Figure 4:
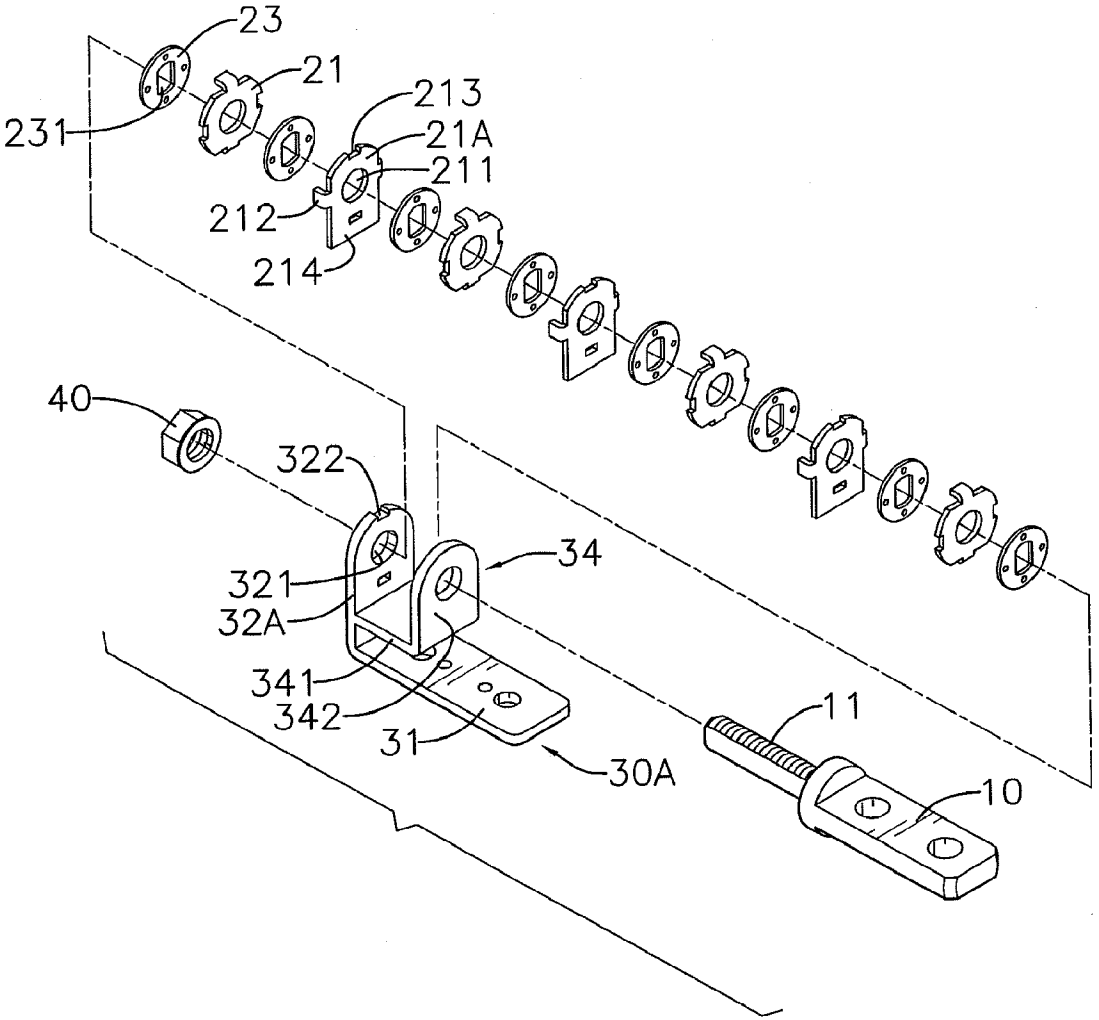
FIG. 4 is an exploded perspective view of the hinge in FIG. 3.
Figure 5:
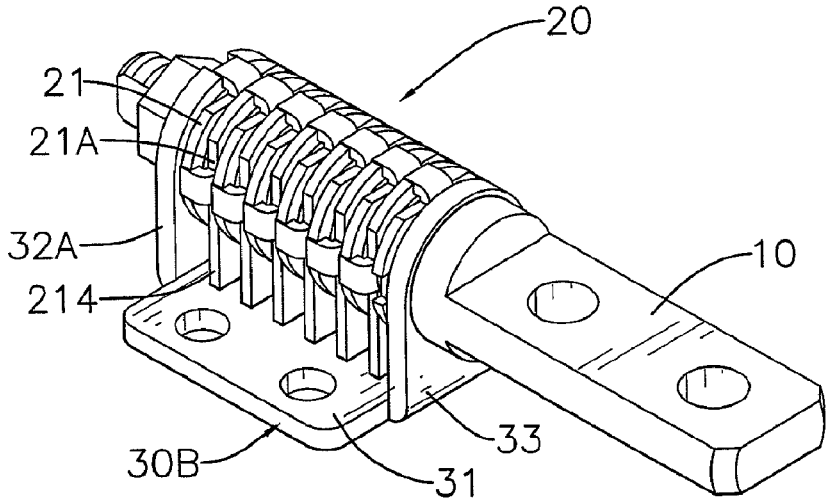
FIG. 5 is a perspective view of a third embodiment of an abrasion-enhanced hinge in accordance with the present invention.
Figure 6:
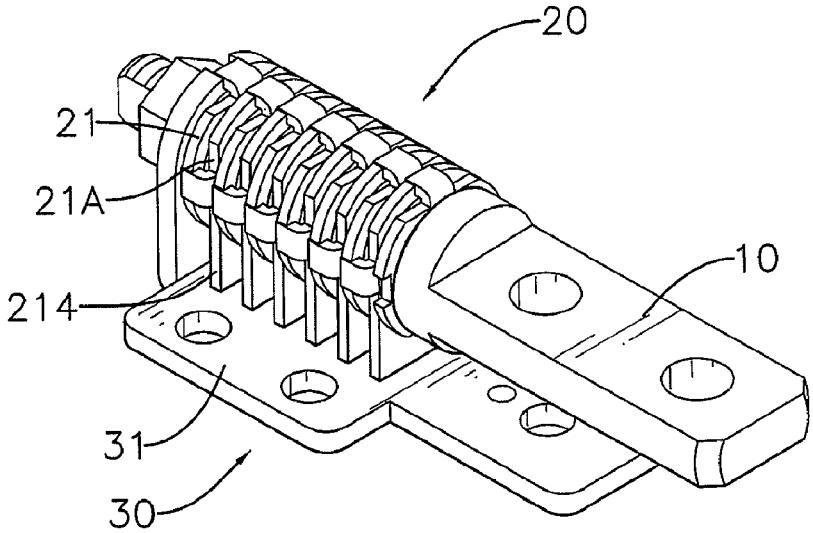
FIG. 6 is a perspective view of a fourth embodiment of an abrasion-enhanced hinge in accordance with the present invention.
Figure 7:
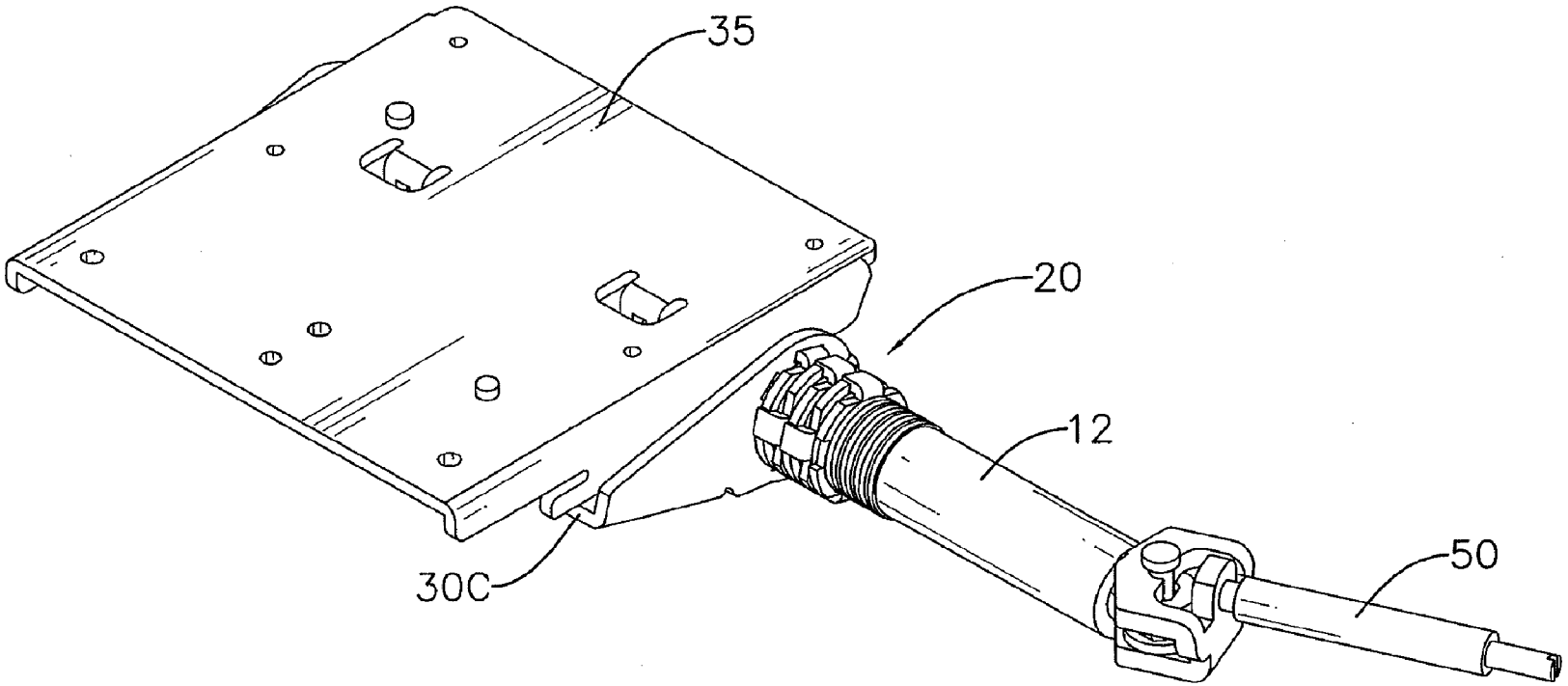
FIG. 7 is a perspective view of a fifth embodiment of an abrasion-enhanced hinge in accordance with the present invention.
Figure 8:
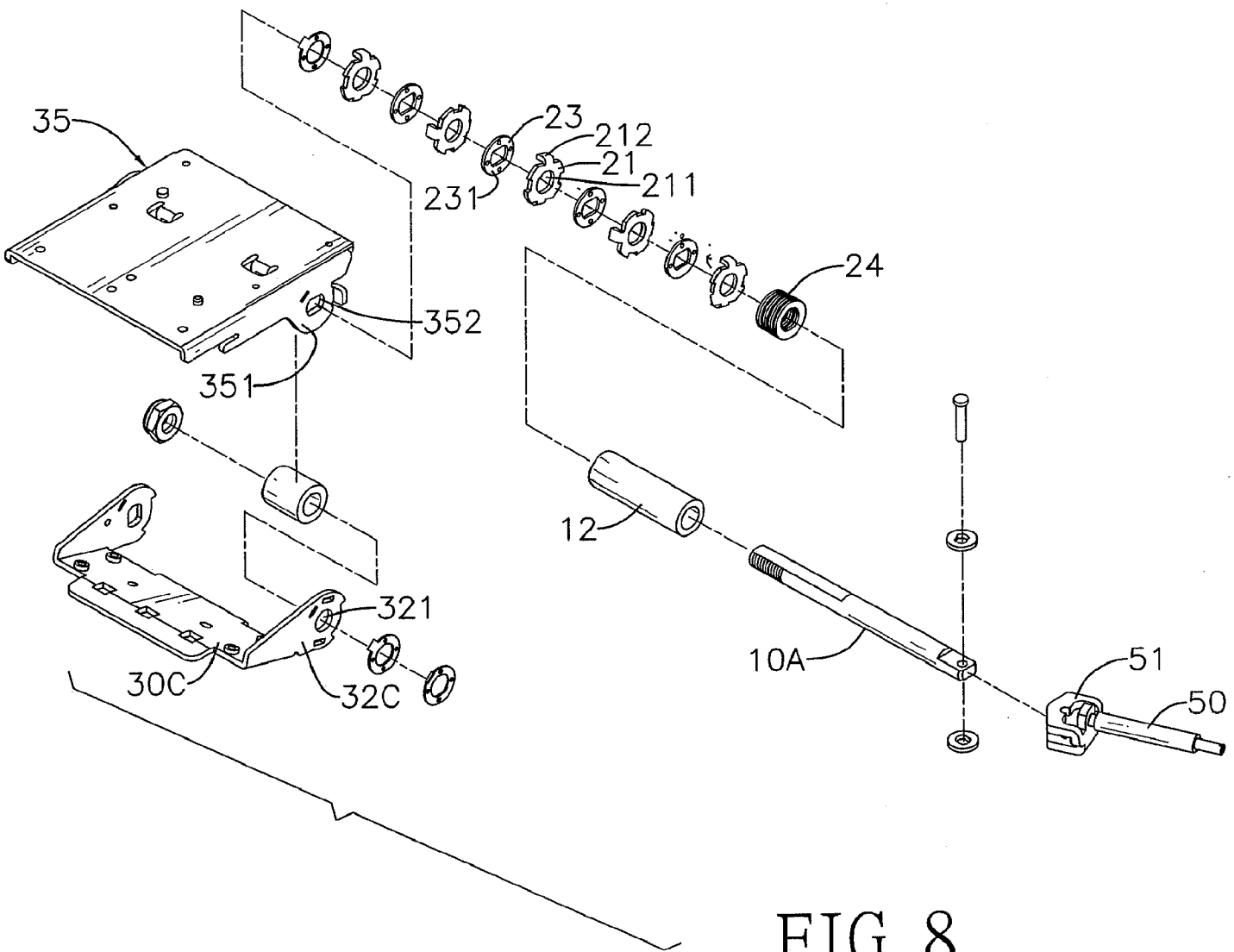
FIG. 8 is an exploded perspective view of the hinge in FIG. 7.

With reference to FIGS. 2 and 8, the pintle (10, 10A) may be non-circular in cross section and has a proximal end, a distal end and an optional threaded segment (11). The threaded segment (11) is formed around the distal end of the pintle (10, 10A).

The adjusting sleeve (12) is mounted around the pintle (10A).

With reference to FIGS. 2, 4, 6 and 8, the washer assembly (20) is mounted around the pintle (10, 10A) and comprises multiple stationary washers (21, 21A), multiple rotating washers (23) and an optional biasing member (24).

The stationary and rotating washers (21, 21A, 23) are mounted interlacedly around the pintle (10, 10A).

The stationary washers (21, 21A) are connected securely to each other in sequence. Each stationary washer (21, 21A) may have an annular edge, a central circular hole (211), two fastening protrusions (212) and two fastening detents (213). The fastening protrusions (212) are formed longitudinally on and protrudes out from the annular edge of the stationary washer (21, 21A) and are opposite to each other. The fastening detents (213) are formed transversely in the annular edge of the stationary washer (21, 21A) and respectively engage the fastening protrusions (212) of an adjacent stationary washer (21, 21A). Some of the stationary washers (21A) respectively have an extension (214). The extension (214) is formed transversely on and protrudes out from the annular edge of the stationary washer (21, 21A).

The rotating washers (23) are mounted securely around the pintle (10, 10A). Each rotating washer (23) may have a central non-circular hole (231) engaging the pintle (10).

The biasing member (24) is mounted around the pintle (10A) and abuts the adjusting sleeve (12).

With reference to FIGS. 2 to 6 and 8, the stationary leaf (30, 30A, 30C) is connected to the washer assembly (20) and has a main panel (31), an optional additional panel (33), a mounting panel (32, 32A, 32C), an optional supplemental bracket (34).

The main panel (31) has two ends and may abut the extensions (214) of the stationary washers (21A).

The mounting and additional panels (32, 32A, 32C, 33) are mounted around the pintle (10, 10A) and are respectively formed perpendicularly on the ends of the main panel (31) to hold the washer assembly (20) between the mounting and additional panels (32, 32A, 33). The mounting panel (32, 32A, 32C) is connected securely to the nearest stationary washer (21) and may have a central hole (321) and two fastening detents (322). The fastening detents (322) are formed in the mounting panel (32, 32A, 32C) and respectively engage the fastening protrusions (212) on the nearest stationary washer (21).

The supplemental bracket (34) is formed on the mounting panel (32A) and comprises a lateral panel (341) and an upright panel (342). The lateral panel (341) is formed perpendicularly on the mounting panel (32A) and may abut the extensions (214) of the stationary washers (21A). The upright panel (342) is formed perpendicularly on the lateral panel (341) and is mounted around the pintle (10) to hold the washer assembly (20) between the mounting panels (32A) and the upright panel (342).

With reference to FIG. 8, the rotating leaf (35) is connected pivotally to the stationary leaf (30C) and has a connecting panel (351). The connecting panel (351) corresponds to and is adjacent to the mounting panel (32C), is mounted securely around the pintle (10A) and has a central non-circular hole (352) engaging the pintle (10A).

The fastener (40) is mounted securely around the distal end of the pintle (10, 10A) and may be a nut being screwed onto the threaded segment (11) of the pintle (10, 10A).

Figure 9:
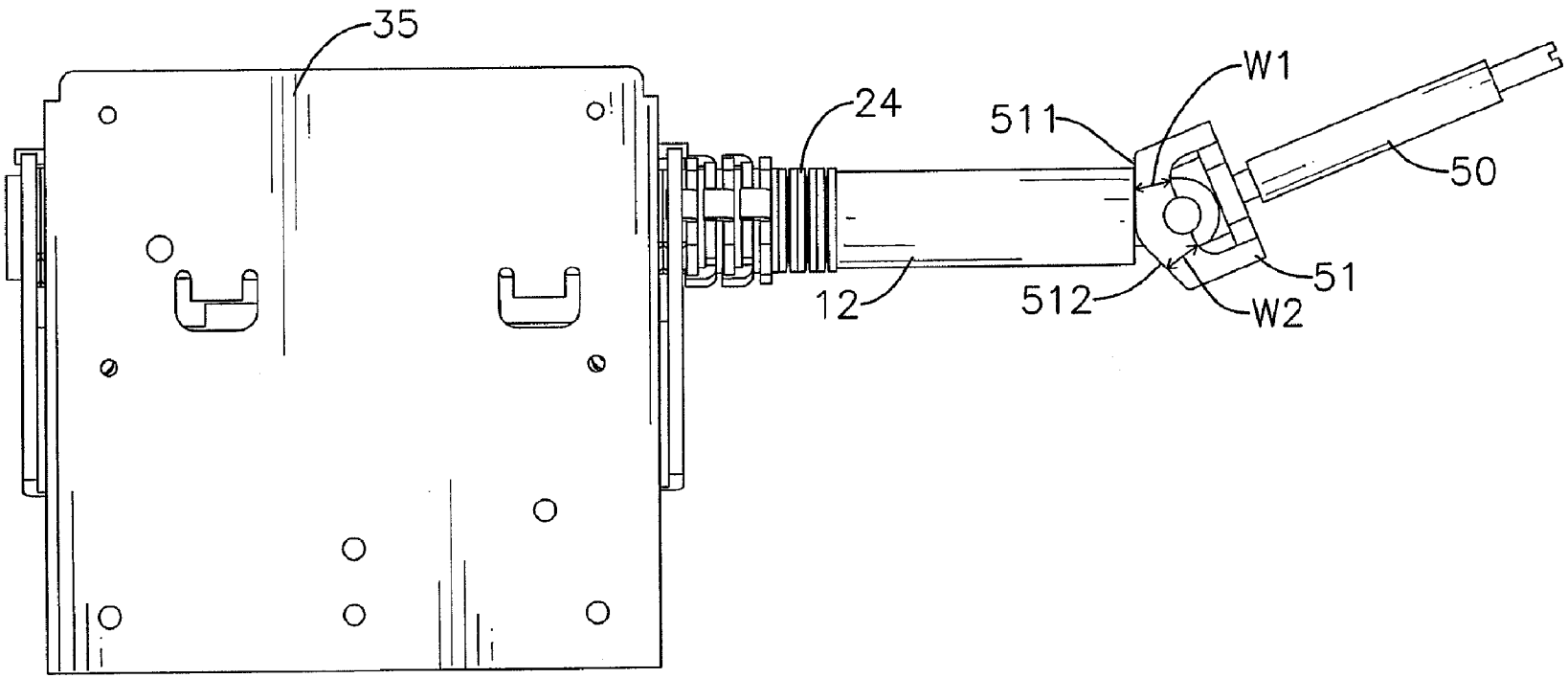
FIG. 9 is an operational top view of the hinge in FIG. 7 when providing less abrasion.
Figure 10:
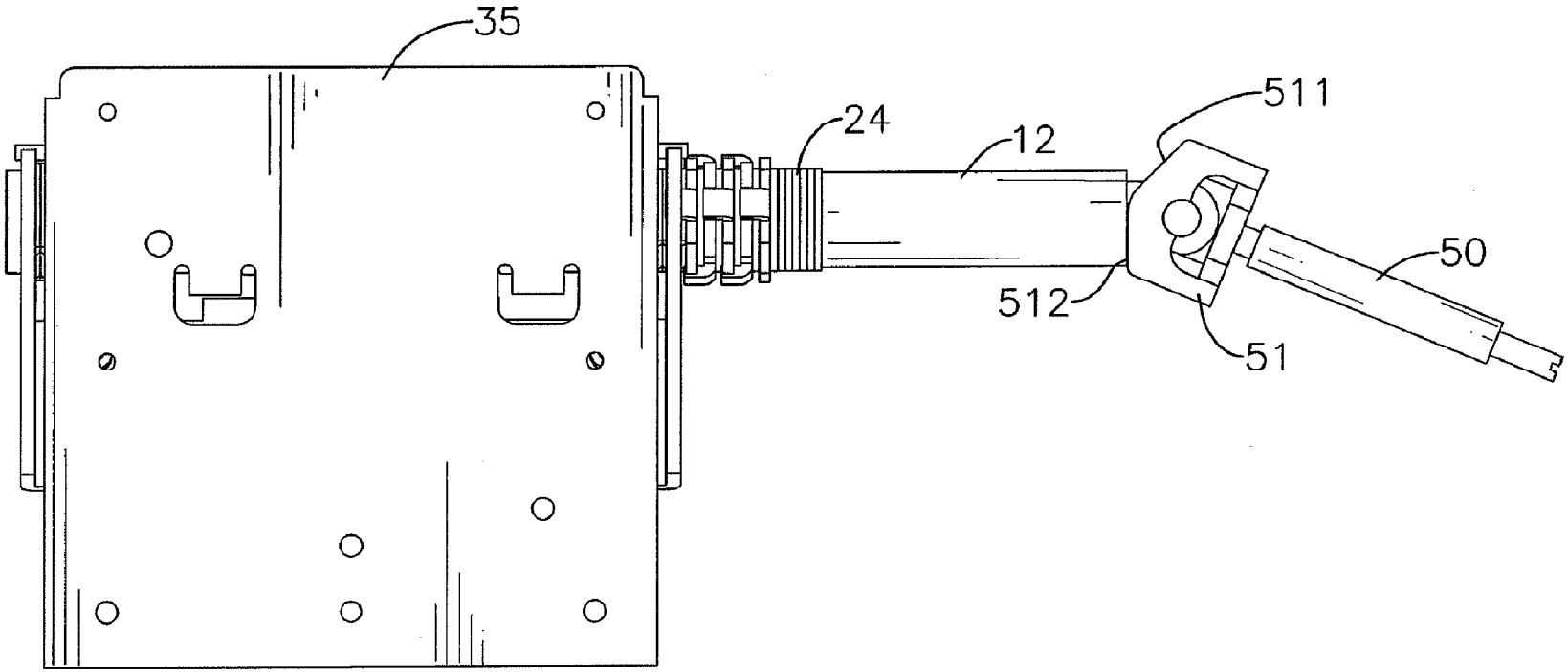
FIG. 10 is an operational top view of the hinge in FIG. 7 when providing more abrasion.

With reference to FIGS. 8 to 10, the adjusting rod (50) is mounted pivotally on the proximal end of the pintle (10A), abuts the adjusting sleeve (12) and has a proximal end and an activating head (51). The activating head (51) is formed on the proximal end of the adjusting rod (50) and has a first activating protrusion (511) and a second activating protrusion (512). The first and second activating protrusions (511, 512) are adjacent to each other. The first activating protrusion (511) selectively abuts the adjusting sleeve (12) and has a width (W1). The second activating protrusion (512) selectively abuts the adjusting sleeve (12) and has a width (W2). The width (W1) of the first activating protrusion (511) is shorter than the width (W2) of the second activating protrusion (512). The adjusting rod (50) is pivoted to change the abutment between the activating protrusions (511, 512) and the adjusting sleeve (12). When the first activating protrusion (511) abuts the adjusting sleeve (12), the hinge as described provides normal abrasion. When the second activating protrusion (512) abuts the adjusting sleeve (12), the hinge as described provides larger abrasion because the longer activating protrusion (512) presses the adjusting sleeve (12) to compress the biasing member (24).

The hinge as described is mounted between a cover and a base of an electronic device. The pintle (10) or the rotating leaf (35) is connected to the cover. The stationary leaf (30, 30A, 30C) is connected to the base. When the cover is pivoted relative to the base, the pintle (10, 10A) is rotated relative to the stationary leaf (30, 30A, 30C). Because the stationary washers (21, 21A) are connected securely to each other and to the stationary leaf (30, 30A, 30C) and the rotating washers (23) are mounted securely around the pintle (10, 10A), the rotating washers (23) are rotated relative the stationary washers (21, 21A). Since the stationary and rotating washers (21, 21A, 23) are mounted interlacedly around the pintle (10, 10A), the rotations between the stationary and rotating washers (21, 21A, 23) provide a lot of abrasions. Therefore, the hinge as described provides enhanced abrasion.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An abrasion-enhanced hinge comprising:

a pintle having a proximal end and a distal end;

a washer assembly being mounted around the pintle and comprising multiple stationary washers rotatably mounted on the pintle and being connected securely to each other in sequence, and each stationary washer has an annular edge;

two fastening protrusions being formed longitudinally on and protruding out from the annular edge of the stationary washer; and two fastening detents being formed transversely in the annular edge of the stationary washer and respectively engaged by the fastening protrusions of an adjacent stationary washer; and multiple rotating washers being non-rotatably and slidably mounted around the pintle, wherein the stationary and rotating washers are mounted interlacedly around the pintle;

a stationary leaf being connected to the washer assembly and having a mounting panel being formed perpendicularly on the stationary leaf, and being mounted around the pintle, the mounting panel having two fastening detents and respectively engaged by the fasting protrusions on the nearest stationary washer; and a fastener mounted securely around the distal end of the pintle.

2. The abrasion-enhanced hinge as claimed in claim 1, wherein some of the stationary washers respectively have an extension being formed transversely on the protruding out from the annular edge of the stationary washer; and the main panel abuts the extensions of the stationary washers.

3. The abrasion-enhanced hinge as claimed in claim 1, wherein some of the stationary washers respectively have an extension being formed transversely on the protruding out from the annular edge of the stationary washer;

the main panel abuts the extensions of the stationary washers; and the stationary leaf further has an additional panel being formed perpendicularly on the other end of the main panel and being mounted around the pintle to hold the washer assembly between the mounting and additional panels.

4. The abrasion-enhanced hinge as claimed in claim 1, wherein some of the stationary washers respectively have an extension being formed transversely on the protruding out from the annular edge of the stationary washer; and the stationary leaf further has a supplemental bracket being formed on the mounting panel and comprising a lateral panel being formed perpendicularly on the mounting panel and abutting the extensions of the stationary washers; and an upright panel being formed perpendicularly on the lateral panel and being mounted around the pintle to hold the washer assembly between the mounting panels and the upright panels.

5. An abrasion-enhanced hinge comprising:

a pintle having a proximal end and a distal end;

a washer assembly being mounted around the pintle and comprising multiple stationary washers being connected securely to each other in sequence; and multiple rotating washers being mounted securely around the pintle, wherein the stationary and rotating washers are mounted interlacedly around the pintle;

a stationary leaf being connected to the washer assembly and having a mounting panel being formed perpendicularly on the stationary leaf, and being mounted around the pintle, the mounting panel being connected securely to a nearest stationary washer;

a fastener mounted securely around the distal end of the pintle;

an adjusting sleeve being mounted around the pintle;

a biasing member being mounted around the pintle and abutting the adjusting sleeve; and an adjusting rod being mounted pivotally on the proximal end of the pintle, abutting the adjusting sleeve and having a proximal end; and an activating head being formed on the proximal end of the adjusting rod and having a first activating protrusion selectively abutting the adjusting sleeve and having a width; and a second activating protrusion being adjacent to the first activating protrusion, selectively abutting the adjusting sleeve and having a width, wherein the width of the first activating protrusion is shorter than the width of the second activating protrusion.

6. The abrasion-enhanced hinge as claimed in claim 1 further comprising an adjusting sleeve being mounted around the pintle;

a biasing member being mounted around the pintle and abutting the adjusting sleeve; and an adjusting rod being mounted pivotally on the proximal end of the pintle, abutting the adjusting sleeve and having a proximal end; and an activating head being formed on the proximal end of the adjusting rod and having a first activating protrusion selectively abutting the adjusting sleeve and having a width.; and a second activating protrusion being adjacent to the first activating protrusion, selectively abutting the adjusting sleeve and having a width, wherein the width of the first activating protrusion is shorter than the width of the second activating protrusion.

7. The abrasion-enhanced hinge as claimed in claim 5 further comprising a rotating leaf being connected pivotally to the stationary leaf and having a connecting panel corresponding to and being adjacent to the mounting panel and being mounted securely around the pintle.

8. The abrasion-enhanced hinge as claimed in claim 6 further comprising a rotating leaf being connected pivotally to the stationary leaf and having a connecting panel corresponding to and being adjacent to the mounting panel and being mounted securely around the pintle.

9. The abrasion-enhanced hinge as claimed in claim 1, wherein the pintle is non-circular in cross section;

each stationary washer has a central circular hole; and each rotating washer has a central non-circular hole engaging the pintle.

10. The abrasion-enhanced hinge as claimed in claim 7, wherein the pintle is non-circular in cross section;

each stationary washer has a central circular hole;

each rotating washer has a central non-circular hole engaging the pintle; and the connecting panel of the rotating leaf has a central non-circular hole engaging the pintle.

11. The abrasion-enhanced hinge as claimed in claim 8, wherein the pintle is non-circular in cross section;

each stationary washer has a central circular hole;

each rotating washer has a central non-circular hole engaging the pintle; and the connecting panel of the rotating leaf has a central non-circular hole engaging the pintle.

12. The abrasion-enhanced hinge as claimed in claim 1, wherein the pintle has a threaded segment formed around the distal end of the pintle; and the fastener is a nut being screwed onto the threaded segment of the pintle.

13. The abrasion-enhanced hinge as claimed in claim 10, wherein the pintle has a threaded segment formed around the distal end of the pintle; and the fastener is a nut being screwed onto the threaded segment of the pintle.

14. The abrasion-enhanced hinge as claimed in claim 11, wherein the pintle has a threaded segment formed around the distal end of the pintle; and the fastener is a nut being screwed onto the threaded segment of the pintle.

* * * * *